US005819566A

United States Patent [19]

Eden, Jr.

[11] Patent Number: 5,819,566

[45] Date of Patent: Oct. 13, 1998

[54] CYLINDER LOCK AND KEY

[75] Inventor: Charles W. Eden, Jr., Plantsville, Conn.

[73] Assignee: International Security Products, Inc., Southington, Conn.

[21] Appl. No.: 789,395

[22] Filed: Jan. 29, 1997

[51] Int. Cl.[6] ..... E05B 27/06

[52] U.S. Cl. ..... 70/358; 70/493; 70/419; 70/409

[58] Field of Search ..... 70/356, 358, 419–421, 70/493, 453, 454, 423, 427, 401, 402, 405–407, 409

[56] References Cited

U.S. PATENT DOCUMENTS

| | | | |
|---|---|---|---|
| 1,204,410 | 11/1916 | Christoph . | |
| 2,687,639 | 8/1954 | Swanson . | |
| 2,857,753 | 10/1958 | Biro | 70/421 |
| 3,264,852 | 8/1966 | Gysin | 70/358 |
| 4,122,694 | 10/1978 | Gretler | 70/406 |
| 4,434,636 | 3/1984 | Prunbauer | 70/358 |
| 4,638,651 | 1/1987 | Surko, Jr. | 70/419 X |
| 4,964,288 | 10/1990 | Braun et al. | 70/406 |
| 5,170,651 | 12/1992 | Errani | 70/493 |
| 5,438,857 | 8/1995 | Kleinhany | 70/493 |
| 5,520,035 | 5/1996 | Eizen et al. | 70/409 X |
| 5,533,369 | 7/1996 | Valdajos-Gallego | 70/493 |
| 5,582,050 | 12/1996 | Haggstrom | 70/495 |

FOREIGN PATENT DOCUMENTS

| | | | |
|---|---|---|---|
| 563276 | 1/1958 | Belgium | 70/405 |
| 3038318 | 6/1981 | Germany | 70/357 |
| 32 25 952 A1 | 12/1984 | Germany . | |
| 4035934 | 6/1991 | Germany | 70/356 |

*Primary Examiner*—Suzanne Dino Barrett
*Attorney, Agent, or Firm*—Alix, Yale & Ristas, LLP

[57] ABSTRACT

A cylinder lock is provided with a resiliently biased auxiliary locking pin which projects into the keyway, the auxiliary locking pin having a first end which is shaped to in part define a flaring tenon and a second end which engages a locking recess in the lock shell. The cooperating key has a blade with a longitudinal slot shaped, in the manner of a mortise, to engage the first end of the auxiliary locking pin, the depth profile of the mortise increasing from an initial engagement depth to a functional depth. Key insertion causes generation of an axial force which is applied to the head of the auxiliary locking pin to retract the pin second end from the shell locking recess.

21 Claims, 5 Drawing Sheets

CYLINDER LOCK AND KEY

BACKGROUND OF THE INVENTION

1. Field of the Invention

The present invention relates to enhancements in providing security for areas to which access is afforded by means of a door and, particularly, to increasing the difficulty of obtaining an unauthorized key for operation of a lock installed in such a door. More specifically, this invention is directed to a mechanical locking system and, especially, to a novel cylinder lock and to a key which cooperates with this novel lock. Accordingly, the general objects of the present invention are to provide novel and improved methods and articles of such character.

2. Description of the Prior Art

Mechanical locks which employ one or more linear arrays of pin tumbler stacks are, of course, well known in the art. The pin tumbler stacks of such locks are radially displaceable, relative to the axis of rotation of a plug or core, in response to insertion of a key in a keyway provided in the core. The pin tumbler stacks are comprised of at least an upper or driver pin, which is spring biased toward the axis of core rotation, and a driven or bottom pin, the pins of each stack being housed in chambers provided in the core and shell of the lock. A properly bitted key will, through communication with bottom pins in chambers in the core, cause pin tumbler stack displacement which, typically, causes the interface between the axially aligned driver and bottom pins to be coincident with a shear line defined by the core outer circumference. Thus, a properly bitted key will permit the core, with the bottom pins, to rotate within a shell. Core rotation will, through the action of a cam or tailpiece coupled thereto, cause operation of a latch or locking mechanism.

Locks of the type generally discussed above are known in the art as "cylinder" locks. The most common manner of defeating a cylinder lock consists of "manufacture" of an unauthorized key. It is believed fair to state that it is not possible to ensure against defeat simply by designing an intricate keyway, i.e., a keyway having a complex profile, and/or through the use of various arrangements of pin tumbler stacks. To the contrary, a high level of security dictates a unique combination of a lock and key, i.e., a lock system which affords the lock manufacturer the ability to exercise key control by means of being the sole source of the key portion of the system.

SUMMARY OF THE INVENTION

The present invention overcomes the above-briefly discussed and other deficiencies and disadvantages of the prior art and, in so doing, provides a novel lock system which is characterized by the use of a key with a blade having a unique shape. This unique blade cooperates with one or more auxiliary locking pins to displace such pins, simultaneously with displacement of pin tumbler stacks by key bitting which functions in the conventional manner, so as to enable rotation of the core relative to the shell.

A lock system in accordance with the invention includes a cylinder lock with a core which carries at least one auxiliary locking pin. In the locked condition of the system, the auxiliary locking pin is engaged in a recess provided in the inner diameter of the shell and thus aids in inhibiting relative movement between the core and shell. The auxiliary pin is reciprocal along an axis which is generally transverse to a plane defined by the keyway and is resiliently biased in the direction of the shell. The auxiliary pin, without a proper key located in the keyway, bridges the shear line between the core and shell. The auxiliary pin is provided with a shaped head portion which extends into the keyway in the locked condition.

The lock system of the invention further includes a key which is provided, in the side of the blade which faces in the direction of the auxiliary locking pin, with a slot sized and shaped to receive the head portion of the auxiliary pin. This key blade slot has a portion of increased depth which is displaced, in the longitudinal direction from the tip of the blade. As the key is inserted in the keyway, the auxiliary pin will be engaged and subsequently pulled, against its resilient bias, inwardly relative to the keyway when it reaches the slot portion of increased depth. The auxiliary pin will, accordingly, be disengaged from the shell, i.e., pulled to the core side of the shear line, simultaneously with displacement of the other pin tumbler stacks of the lock to the unlocked condition by the other, i.e., conventional, bitting on the blade.

In accordance with a preferred embodiment of the invention, the head portion of the auxiliary pin and the cooperating recess in the side of the key blade respectively constitute a tenon and mortise and, in one embodiment, a loosely fitting dovetail joint.

BRIEF DESCRIPTION OF THE DRAWING

The present invention may be better understood, and its numerous objects and advantages will become apparent to those skilled in the art, by reference to the accompanying drawing wherein like reference numerals refer to like elements in the several figures and in which.

DESCRIPTION OF THE DISCLOSED EMBODIMENT

Figure 1:
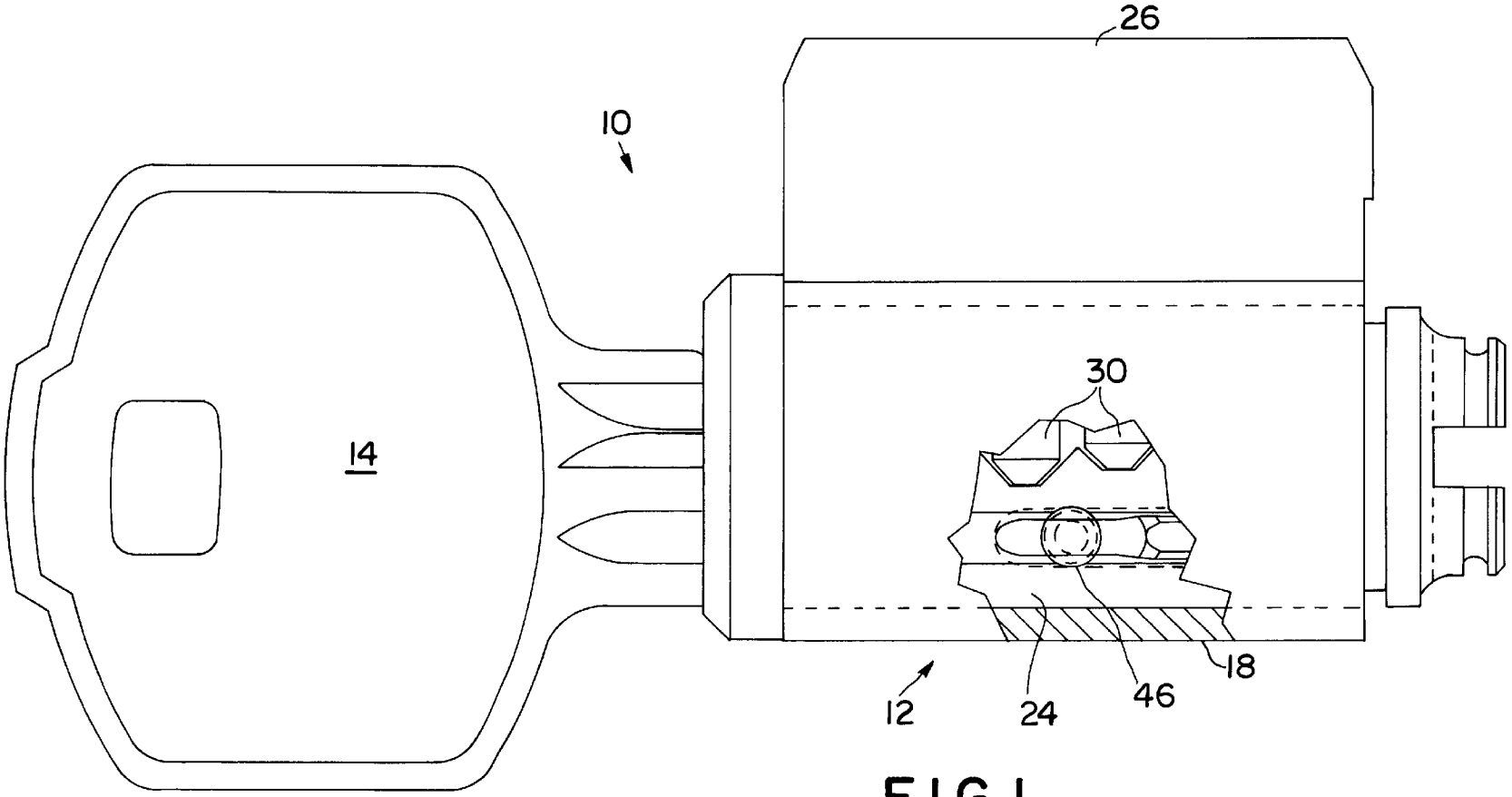
FIG. 1 is a side elevation view, partly broken away to reveal detail, of a lock system in accordance with the present invention.
Figure 2:
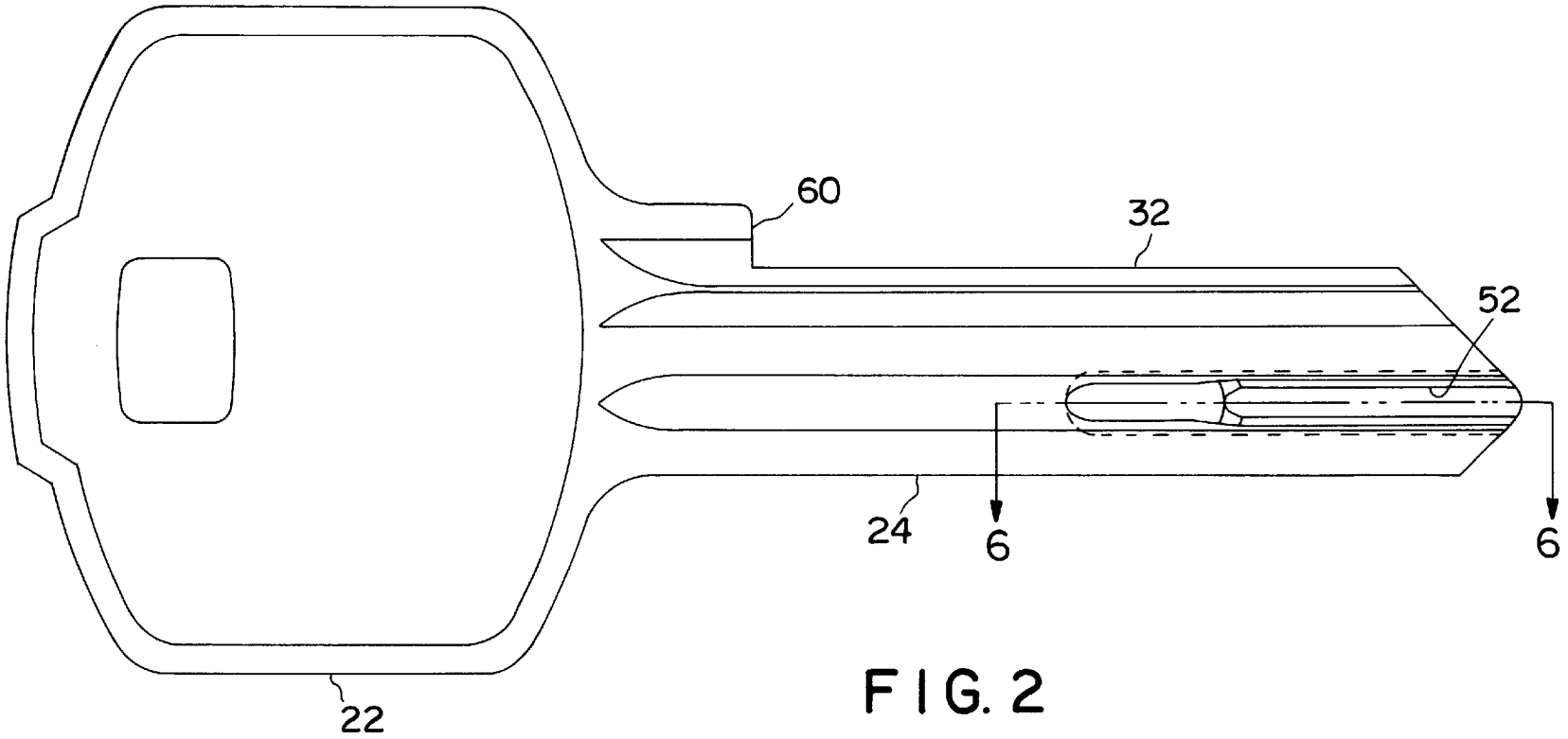
FIG. 2 is a side elevation view of the blank from which the key portion of the lock system of FIG. 1 is formed by producing the cuts which define the bitting.

The disclosed embodiment of applicant's invention will now be described with reference to the drawing. It is to be noted that conventional elements of the lock have been omitted from the drawing in the interest of facilitating understanding of the invention.

Figure 4:
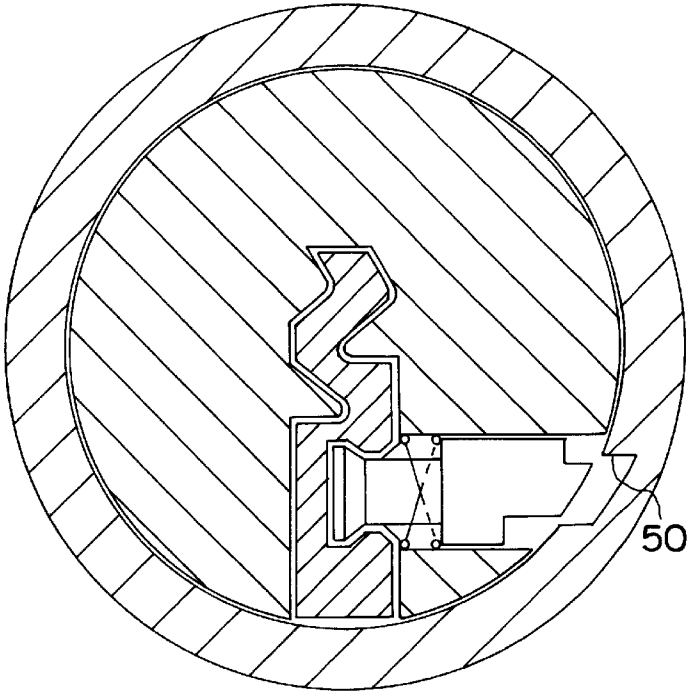
FIG. 4 is a cross-sectional view, similar to FIG. 3, but depicting the lock upon initial key insertion.

A lock system in accordance with the invention is indicated generally at 10 in FIG. 1. The lock system is comprised of a cylinder lock, indicated generally at 12, and a cooperating key 14. Cylinder lock 12, as is conventional, comprises a core 16, see FIGS. 3–5, which is rotatable about an axis within and relative to a shell 18. The boundary between core 16 and shell 18 defines a shear line. The core 16 is provided with a keyway 20 having a profile, i.e., a cross-sectional shape, which is unique to the lock. Key 14 is comprised of a bow portion 22 and a blade 24. Blade 24 will be formed, i.e., the side faces of the key blank will be milled, so that the profile of blade 24 matches the shape of keyway 20.

Figure 5:
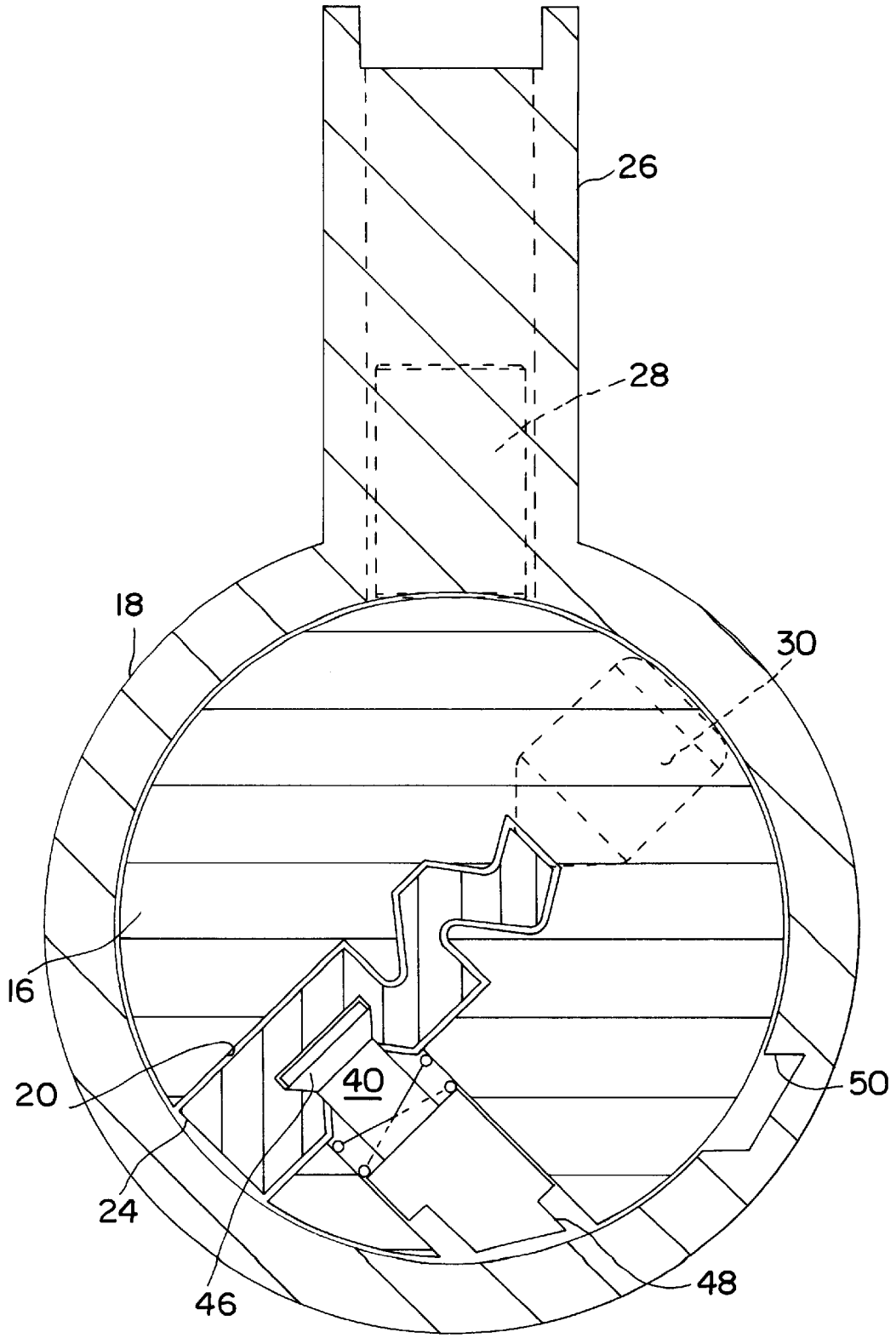
FIG. 5 is a cross-sectional view, taken along line 5—5 of FIG. 1, which depicts the lock in the unlocked condition.

As is also conventional, cylinder lock 12 will be provided with one or more arrays of pin tumbler stacks. Each pin tumbler stack will comprise at least a top or driver pin and a bottom or driven pin. The pin tumbler stacks are housed in pin tumbler chambers provided in the core 16 and shell 18, the chambers in the core and shell which receive a given pin tumbler stack being in axial alignment when the lock is in the locked state and the chambers in the core being in communication with the keyway. In the disclosed embodiment of the invention, the pin tumbler stacks are, in part, housed in an extension 26 of shell 18, such an extension being known in the art as a "bible". Referring to FIG. 5, a top pin of a pin tumbler stack is indicated in phantom at 28 while the bottom pin of the same pin tumbler stack is indicated in phantom at 30. It will be understood that the pin tumbler stacks are biased in the direction of the axis of rotation of core 16 by springs, not shown. In the locked condition, one of the pins of each pin tumbler stack extends across the shear line, i.e., is partly in a chamber in each the shell and core, and thus prevents rotation of the core relative to the shell. Rotation of the core relative to the shell is conventionally enabled by providing the key blade with bitting, i.e., surface irregularities, which engage the bottom pins whereby the pin tumbler stacks are displaced so that the interface between the driver and driven pins is located on the shear line. In the embodiment disclosed, the key bitting would be in the form of serrations on the edge 32 of key blade 24. The bible 26 and the conventional pin tumblers do not comprise part of the present invention and, accordingly, have not been included in FIGS. 3 and 4.

In accordance with the present invention, the cylinder lock 12 is provided with at least one auxiliary locking pin 40. Pin 40 is housed, for reciprocal motion, in a pin chamber 42 which extends between the side of keyway 20 and the circumference of core 16. Pin chamber 42 is provided with an inwardly extending rim or shoulder at the end thereof which is in communication with the keyway and a biasing spring 44 is located between this shoulder and a facing shoulder on pin 40. Spring 44, which is shown schematically, thus biases pin 40 outwardly, i.e., in a direction which is generally transverse to the substantially parallel planes defined by the keyway and the uncut side faces of blade 24 of the key blank. As clearly shown in FIGS. 3–5, the axis along which the pin 40 moves is off-center, i.e., the longitudinal axis of pin 40 does not intersect the axis of rotation of core 16. Auxiliary pin 40 has a shaped head portion 46 which, when viewed in cross-section in a plane transverse to the keyway (see FIGS. 3–5), has the general shape of a flaring tenon. Thus, auxiliary pin 40, at the inwardly disposed end thereof, tapers outwardly from a reduced diameter intermediate portion to a cylindrical end region. The tapered, i.e., frustoconical, surface of pin 40 defines, as will be described below, a reaction surface against which an axial force is applied. The opposite end of auxiliary locking pin 40, i.e., the portion of pin 40 disposed on the shell side of the reduced diameter intermediate portion, has an irregular shape which terminates, at the end of the pin 40 disposed oppositely with respect to head 46, in a projection 48 with a face which is directed away from the keyway. The shape, of the face of projection 48 is generally complementary to the outer circumference of core 16, and thus also to the inner circumference of shell 18, in the embodiment depicted in FIGS. 3 and 4. The junction of the enlarged second end portion and intermediate portion of auxiliary pin 40 defines the above-mentioned shoulder against which the biasing spring 44 acts.

Figure 3:
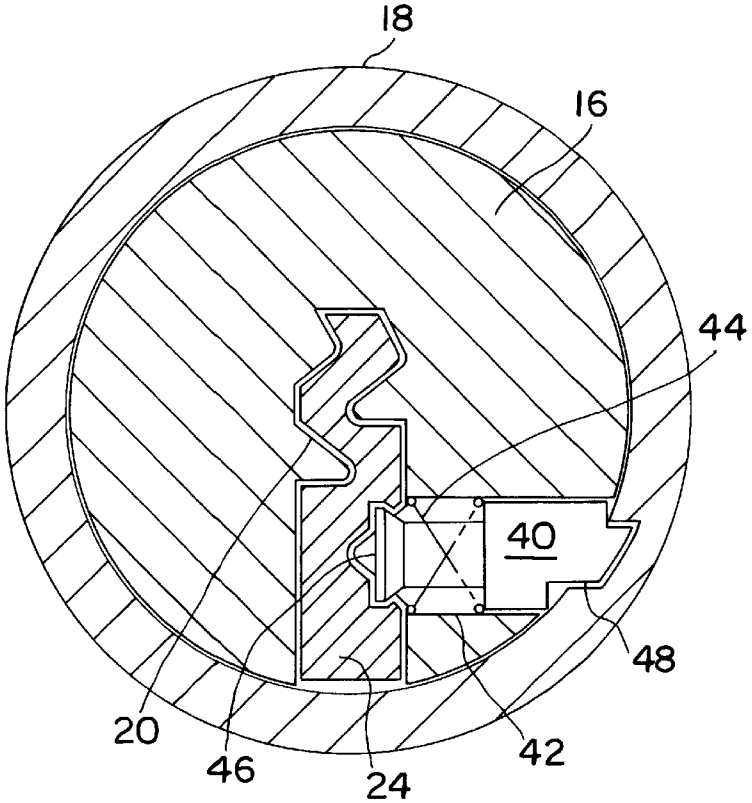
FIG. 3 is a cross-sectional view, taken transverse to in FIG. 1, which schematically illustrate the operation of a lock in accordance with the present invention, FIG. 3 depicting the lock upon initial key insertion.

Auxiliary pin 40, particularly the projection 48 which defines the second end thereof, cooperates with a recess 50 provided in the inner wall of shell 18. Thus, with the lock in the locked state as represented by FIG. 3, projection 48 is located in recess 50 and auxiliary pin 40 thus bridges the shear line and cooperates with the pin tumbler stacks of the lock to prevent relative rotation between the plug and shell.

Figure 7:
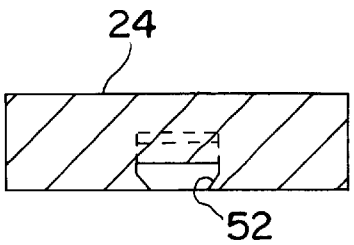
FIG. 7 is a cross-sectional view taken along line 7—7 of FIG. 6.
Figure 6:
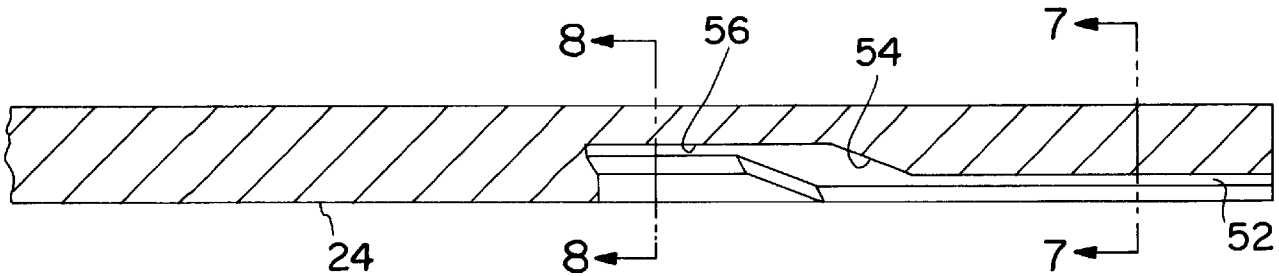
FIG. 6 is an enlarged cross-sectional view, taken along line 6—6 of FIG. 2, which partially depicts a portion of the key blade.
Figure 8:
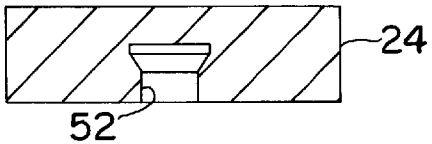
FIG. 8 is a cross-sectional view of the key blade along line 8—8 of FIG. 6.

Referring to FIGS. 2 and 6–8, the side of the blade 24 of key 14 which faces the head of auxiliary pin 40 is provided with a longitudinal slot 52 of varying depth. Slot 52 has a shape which is complementary to that of the head 46 of pin 40. Restated, key blade 24, extending longitudinally from the blade tip, has a slot 52 which functions as a mortise into which the tenon defined by the head portion 46 of auxiliary locking pin 40 loosely fits. Slot 52, particularly the surface of the mortise which will cooperate with the reaction surface of the auxiliary locking pin, has an initial depth which insures that head 46, which at all times projects into the keyway, will be received in slot 52. Slot 52 also includes, in the disclosed embodiment, a ramp section 54 where the slot deviates from the initial depth to a maximum functional depth which exceeds the depth of recess 50. Thus, when the key blade 24 is inserted in keyway 20, the section of slot 52 which is depicted in FIGS. 3 and 7 will receive and capture head portion 46 of auxiliary pin 40 and the cooperating surfaces of the tenon and mortise will be in an abutting relationship. As the key blade is inserted further into the keyway, the key will initially slide relative to auxiliary pin 40 without any force being transmitted from the mortise surfaces to the head of the auxiliary pin. When the stepped or ramp section 54 of the slot 52 in the key blade reaches the head portion 46 of pin 40, the displacement of the force transmission surfaces of the mortise from the side of the keyway begins to increase and an axial component of force will be exerted on the tapered reaction surface of pin 40 by the complementary mortise surfaces and the pin will be pulled inwardly against the force of biasing spring 44. When the key is fully inserted, i.e., when the stop shoulder 60 on the key blade is in contact with the face of the core 16 above the keyway, the head 46 of auxiliary pin 40 will be located in the deepest section 56 of slot 52. At this time, the auxiliary pin 40 will have been pulled inwardly sufficiently to retract projection 48 from recess 50 in shell 18, i.e., the auxiliary locking pin will be in the state depicted in FIG. 4. Accordingly, and presuming that the key is otherwise correctly bitted, the core 16 may be rotated relative to the shell 18 as shown in FIG. 5.

Figure 9:
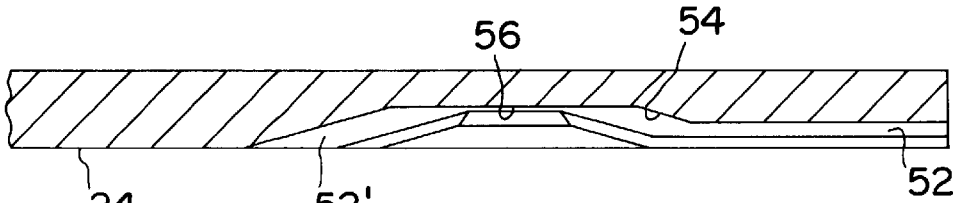
FIG. 9 is an enlarged cross-sectional view, similar to FIG. 6, which depicts a modified key blade.

FIG. 5 also shows that the end of projection 48 of auxiliary locking pin 40 does not have to be complementary in shape to the outer diameter of core 16, i.e., in the interest of reducing manufacturing costs, the end face of projection 48 may be flat. FIG. 5 further depicts the bottom of slot 52, at its maximum or functional depth, as lying on the opposite side of plane A—A, which extends through the center of the blade 24 of key 14, from the face which is machined to form the slot. While this is the preferred arrangement, the depth of slot 52 may be varied as necessary or desirable to achieve the above-described operational mode. Also, as shown in FIG. 9, the slot 52 may be continued longitudinally past the position of the auxiliary locking pin as indicated at 52; and reduce in depth on the bow side of the locking pin so as to transition to the blade face. Such an arrangement would be in the interest of facilitating cleaning of the slot. Likewise, as will obvious to those skilled in the art, it is possible to employ a plurality of auxiliary pins 40, i.e., the lock 10 could be provided with an array of auxiliary locking pins and the pins of such an array could be of different length. The depth of slot section 52; when present, may constantly vary in depth from the portion of maximum depth rather than changing in step(s).

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A cylinder lock comprising:

a shell, said shell having a plurality of pin tumbler receiving chambers, said shell further having an interior surface which defines a core receiving chamber having a longitudinal axis, said pin tumbler receiving chambers each extending to said interior surface and having an axis which is generally radially oriented with respect to said longitudinal axis, said shell interior surface being provided with at least a first recess, said shell being mounted with a fixed orientation in the use environment of said lock;

a core cooperating with said shell to form the relatively rotatable component of said lock, said core having an exterior surface and being disposed within said core receiving chamber of said shell for rotation about said longitudinal axis, said core including a longitudinally extending keyway, said keyway having a pair of oppositely disposed sides, said sides defining therebetween a first plane in which said longitudinal axis lies, said core also having a plurality of pin tumbler receiving chambers, each of said core pin tumbler receiving chambers having an axis and being axially alignable with an associated one of said shell pin tumbler receiving chambers in the locked condition of said cylinder lock, said core pin tumbler receiving chambers extending between said keyway and said exterior surface of said core whereby communication may be established between said shell and core pin tumbler receiving chambers, a shear line for said lock being defined by the interface between said interior surface of said shell and said exterior surface of said core, said core further having at least a first auxiliary locking pin receiving chamber which extends along an uninterrupted linear axis between a first side of said keyway and said core exterior surface, said first auxiliary locking pin receiving chamber axis being generally transverse to said keyway defined first plane, said axis of said first auxiliary locking pin receiving chamber intersecting said keyway defined first plane at a point offset from said longitudinal axis, said axis of said first auxiliary locking pin receiving chamber being in registration with said shell first recess when said lock is in the locked condition with said pin tumbler receiving chambers of said shell and core in axial alignment;

a plurality of reciprocally movable pin tumblers, said pin tumblers each having at least a bottom pin and a driver pin, said pins each having an axis, said pin tumblers being disposed in said pin tumbler receiving chambers with the pins of each of said pin tumblers being in axial alignment when said core and shell pin tumbler receiving chambers are in axial alignment, said pin tumblers being movable as units when the pins thereof are in axial alignment, at least one of said pins of at least some of said pin tumblers normally extending across said shear line so as to be partly disposed in an aligned shell pin tumbler receiving chamber and core pin tumbler receiving chamber in the locked condition of said lock, said pin tumblers each further including a first spring for biasing said driver pins in the direction of said longitudinal axis;

an auxiliary locking pin reciprocally disposed in said core first auxiliary locking pin receiving chamber, said auxiliary locking pin defining an uninterrupted linear axis and having a shaped head portion at a first end thereof, said head portion at all times extending into said keyway, the second opposite end of said auxiliary locking pin being located in said first recess in said shell interior surface in the locked condition of said cylinder lock, said second end of said auxiliary locking pin terminating at a face which is directed generally away from said keyway, said auxiliary locking pin axis lying in a second plane which is substantially transverse to said keyway defined first plane in the locked condition of said lock, said face intersecting said auxiliary locking pin axis at an angle whereby said face is displaced from said keyway defined plane by a greater distance on a first side of said second plane than on a second opposite side of said second plane, said head portion of said auxiliary locking pin including a reaction surface against which a force directed axially with respect to said auxiliary locking pin may be exerted, said reaction surface facing generally toward said second end of said auxiliary locking pin; and an auxiliary locking pin spring for applying an axial resilient bias force to said auxiliary locking pin to urge said second end of said auxiliary locking pin said keyway and toward said shell interior surface where said auxiliary locking will into said shell first recess in the locked condition of said cylinder lock whereby the auxiliary locking pin will extend across said shear line and prevent rotation of said core relative to said shell in the absence of the application of a force to said auxiliary locking head portion reaction surface which is in a direction opposite to and in excess of said resilient bias force.

2. The cylinder lock of claim 1 wherein said head portion of said auxiliary locking pin in part defines a flaring tenon.

3. The cylinder lock of claim 1 wherein said auxiliary locking pin second end has a shape which is in part generally complementary to the shape of said shell first recess, and wherein said shell first recess and said locking pin second end are provided with wall surfaces which coact to prevent rotation of said core relative to said shell when said auxiliary locking pin second end is located in said first recess.

4. The cylinder lock of claim 3 wherein said head portion of said auxiliary locking pin in part defines a flaring tenon.

5. The cylinder lock of claim 4 wherein said face of said second end of said auxiliary locking pin is substantially flat.

6. A cylinder lock system comprising:

a shell, said shell defining a plurality of pin tumbler receiving chambers, said shell further having an interior surface which defines a core receiving chamber having a longitudinal axis, said pin tumbler receiving chambers each having an axis and communicating with said shell interior surface, said shell interior surface being provided with at least a first recess, said shell being mounted with a fixed orientation in the use environment of the lock of said system;

a core cooperating with said shell to form the relatively rotatable component of the lock of said system, said core having an exterior surface and being disposed within said core receiving chamber of said shell for rotation about said longitudinal axis, said core including a longitudinally extending keyway, said keyway having oppositely disposed sides and defining therebetween a first plane in which said longitudinal axis lies, said core also having a plurality of pin tumbler receiving chambers, said core pin tumbler receiving chambers each having an axis, said core pin tumbler receiving chambers being axially alignable with an associated one of said shell pin tumbler receiving chambers to define the locked condition of the lock of said system, said core pin tumbler receiving chambers extending between said keyway and said exterior surface of said core whereby communication may be established between said shell and core pin tumbler receiving chambers, a shear line for the lock of said system being defined by the interface between said interior surface of said shell and said exterior surface of said core, said core further having at least a first open-ended auxiliary locking pin receiving chamber which extends along an uninterrupted linear axis between a first side of said keyway and said core exterior surface, the opening of said auxiliary locking pin receiving chamber into said keyway first side having a length measured along the keyway, said auxiliary locking pin receiving chamber axis intersecting said shell first recess when said pin tumbler receiving chambers of said shell and core are in axial alignment, said auxiliary locking pin receiving chamber linear axis intersecting said keyway defined first plane at a point offset from said longitudinal axis;

a plurality of pin tumblers, said pin tumblers each having at least a bottom pin and a driver pin, said pins each having an axis, said pin tumblers being disposed in said pin tumbler receiving chambers with the pins of each of said pin tumblers being in axial alignment when said core and shell pin tumbler receiving chambers are in axial alignment, axial alignment of said core and shell pin tumbler receiving chambers permitting reciprocal motion of said pin tumblers, at least one of said pins of each of said pin tumblers extending across said shear line so as to be partly disposed in an aligned shell pin tumbler receiving chamber and core pin tumbler receiving chamber in the absence of a properly bitted key in said keyway, said pin tumblers each further including a spring for urging said driver pins in the direction of said core;

an auxiliary locking pin reciprocally disposed in said core auxiliary locking pin receiving chamber, said auxiliary locking pin defining an uninterrupted linear axis and having a shaped head portion at a first end thereof, said head portion at all times at least partly extending into said keyway, the second opposite end of said auxiliary locking pin being sized and shaped to be received in said first recess in said shell interior surface, said head portion of said auxiliary locking pin including a reaction surface against which a force directed axially with respect to said auxiliary locking pin may be exerted, said reaction surface facing generally toward said second end of said auxiliary locking pin and being spaced from said keyway first side by a first distance in the absence of a proper key in said keyway;

an auxiliary locking pin spring for applying an axial resilient bias force to said auxiliary locking pin to urge said second end of said auxiliary locking pin away from said keyway and toward said shell interior surface whereby said auxiliary locking pin will extend across said shear line into said shell first recess and prevent rotation of said core relative to said shell in the absence of the application of an axial force to said auxiliary locking pin head portion reaction surface which is in a direction opposite to and in excess of said resilient bias force; and a key, said key comprising a bow and a blade which extends longitudinally from said bow to a blade tip, said blade having a pair of spacially displaced side surfaces which are at least in part substantially parallel, said blade further having surface irregularities which contact and cooperate with said pin tumbler bottom pins to impart axial motion to said pin tumblers in opposition to the urging of said pin tumbler springs, said surface irregularities in part defining the key bitting, at least one of said blade side surfaces being provided with a longitudinal groove extending from the vicinity of said tip toward said bow, said longitudinal groove having an open end which faces in the direction of said blade tip and being positioned and shaped to receive said part of said auxiliary locking pin head portion which extends into said keyway, said longitudinal groove being in part defined by at least a first force transmitting wall surface which is at least in part complementary to the shape of said auxiliary locking pin head portion reaction surface whereby said head portion may be captured on said groove, said force transmitting wall surface of said groove having a first constant displacement from said keyway first side in a first linear section thereof extending from said open end and having a second substantially constant displacement from said keyway first side in a second linear section thereof which is displaced from said blade tip by said first groove section, said second displacement being greater than said first displacement, at least a part of said second groove section being in registration with said auxiliary locking pin when said key blade is fully inserted in said keyway, the displacement of said groove force transmitting wall surface from said keyway first side transitioning smoothly from said first displacement to said second displacement, said first displacement being commensurate with said first distance said auxiliary locking pin reaction surface is spaced from said keyway first side in the absence of a proper key in said keyway whereby said auxiliary locking pin head portion may be received in said groove at said open end thereof and relative movement between said blade and auxiliary locking pin during initial key insertion will not cause a force which exceeds said axial resilient bias force to be transmitted to said auxiliary locking pin head portion reaction surface by said groove force transmitting wall surface, insertion of said key blade into said keyway with said locking pin head portion received in said groove to the point where said displacement of said groove force transmission wall surface transitions to said second displacement resulting in generation of and application to said reaction surface of said auxiliary locking pin head by said groove force transmitting wall surface of an axial force of sufficient magnitude to overcome the bias of said auxiliary locking pin spring.

7. The cylinder lock system of claim 6 wherein said head portion of said auxiliary locking pin in part defines a flaring tenon.

8. The cylinder lock of claim 6 wherein said auxiliary locking pin second end terminates in a face which is directed away from said keyway, said shell first recess and said auxiliary locking pin second end having side wall surfaces which coact to prevent rotation of said core relative to said shell when said auxiliary locking pin second end is received in said first recess, said auxiliary locking pin axis lying in a second plane which is substantially transverse to said keyway defined first plane in the locked condition of the lock of said system, said face of said auxiliary locking pin second end intersecting said auxiliary locking pin axis at an angle whereby said face is displaced from said keyway defined plane by a greater distance on a first side of said second plane than on a second opposite side of said second plane.

9. The cylinder lock system of claim 8 wherein said head of said auxiliary locking pin in part defines a flaring tenon.

10. The cylinder lock system of claim 6 wherein said longitudinal groove in said key blade defines a mortise.

11. The cylinder lock system of claim 10 wherein said mortise includes said force transmitting wall surface which is generally complementary in shape to said auxiliary locking pin head portion reaction surface.

12. The cylinder lock system of claim 11 wherein said head portion of said auxiliary locking pin in part defines a flaring tenon, said tenon defining said reaction surface.

13. The cylinder lock system of claim 6 wherein said transition of said displacement of said key blade groove defining force transmission surface occurs in a third linear section of said groove, said third groove section being disposed between said first and second linear groove sections.

14. The cylinder lock system of claim 12 wherein said transition of said displacement of said key blade groove defining force transmission surface occurs in a third linear section of said groove, said third groove section being disposed between said first and second linear groove sections.

15. The cylinder lock of claim 14 wherein said auxiliary locking pin second end includes a face which is directed away from said keyway, said shell first recess and said auxiliary locking pin second end being provided with side wall surfaces which may coact to prevent rotation of said core relative to said shell, said face of said auxiliary locking pin second end intersecting said auxiliary locking pin axis at an angle whereby the distance between said face and said keyway defined plane measured in the circumferential direction of said shell interior surface is different on opposite sides of said auxiliary locking pin axis.

16. The cylinder lock of claim 6 wherein said groove has a base and continues past said second linear section toward said bow, said groove base and force transmitting wall surface transitioning to said one blade side surface in said continuation thereof.

17. The cylinder lock of claim 9 wherein said groove has a base and continues past said second linear section toward said bow, said groove base and force transmitting wall surface transitioning to said one blade side surface in said continuation thereof.

18. The cylinder lock of claim 15 wherein said groove has a base and continues past said second linear section toward said bow, said groove base and force transmitting wall surface transitioning to said one blade side surface in said continuation thereof.

19. A key blank for use with a cylinder lock having a keyway and at least a first resiliently biased auxiliary locking pin, the keyway having sides which define parallel planes, the auxiliary locking pin being reciprocal along an axis and having a shaped head portion which extends into the lock keyway from a first side thereof, the shaped head portion being at a first end of the auxiliary locking pin and including a reaction surface which generally faces the keyway first side, said key blank comprising:

a bow;

a blade longitudinally extending from said bow and terminating at a tip, said blade having first and second spacially displaced sides and a pair of oppositely disposed and spaced edges which interconnect said sides, said first and second sides being at least in part substantially parallel to one another and to the keyway side defined planes; and a groove extending longitudinally along at least a first of said blade sides from the vicinity of said blade tip in the direction of said bow, said groove having an open end which faces in the direction of said blade tip and having a size and shape which permits entry of and capture of the head portion of an auxiliary locking pin, said groove defining a mortise which is complementary in shape to at least a portion of the reaction surface of the shaped head portion of the auxiliary locking pin, said complementary groove shape including a force transmission surface which faces generally in the direction of the second of said blade sides, said groove having a first linear section wherein the spacing of said force transmission surface from said blade first side is constant, said groove first linear section extending from said open end, said groove first linear section transitioning smoothly into a groove second linear section wherein the spacing of said force transmission surface from said blade first side is constant and greater than said spacing of said first linear section, said transition in death occurring in a third linear section of said groove disposed between said first and second linear groove sections, said second linear section of said groove being located in a longitudinal region along said blade which is displaced from said open end by said first and third groove linear sections.

20. The key blank of claim 19 wherein said groove first depth is less than one half of the thickness of said blade and said groove second depth exceeds one half of the thickness of said blade.

21. The cylinder lock of claim 19 wherein said groove has a base and continues past said second linear section toward said bow, said groove base and force transmitting wall surface transitioning to said one blade side surface in said continuation thereof.

* * * * *

UNITED STATES PATENT AND TRADEMARK OFFICE

CERTIFICATE OF CORRECTION

PATENT NO. : 5,819,566
DATED : October 13, 1998
INVENTOR(S) : Eden, Jr.

It is certified that error appears in the above-identified patent and that said Letters Patent is hereby corrected as shown below:

Column 6,
Lines 38-40, delete "said keyway and toward said shell interior surface where said auxiliary locking will".

Column 10,
Line 42, delete "death" and insert -- depth --.

Signed and Sealed this

Twenty-fourth Day of September, 2002

*Attest:*

*Attesting Officer*

JAMES E. ROGAN
*Director of the United States Patent and Trademark Office*